United States Patent [19]

Belbel et al.

[11] Patent Number: 4,571,565

[45] Date of Patent: Feb. 18, 1986

[54] CONTROLLED OPENING AND CLOSING SWITCH WITH AUTOMATIC OPENING IN THE EVENT OF CURRENT OVERLOAD

[75] Inventors: Elie Belbel, Epinay; Andreé Haury, Le Raincy; Christian Blanchard, Nanterre; Michel Lauraire, Courbevoie, all of France

[73] Assignee: La Telemecanique Electrique, Nanterre, France

[21] Appl. No.: 639,417

[22] PCT Filed: Jan. 4, 1984

[86] PCT No.: PCT/FR84/00003

§ 371 Date: Aug. 14, 1984

§ 102(e) Date: Aug. 14, 1984

[87] PCT Pub. No.: WO84/02802

PCT Pub. Date: Jul. 19, 1984

[30] Foreign Application Priority Data

Jan. 5, 1983 [FR] France ..... 83 00086

[51] Int. Cl.[4] ..... H01H 77/02; H01H 75/10

[52] U.S. Cl. ..... 335/16; 335/6

[58] Field of Search ..... 335/16, 6

[56] References Cited

U.S. PATENT DOCUMENTS 2,944,129 7/1960 Cole ..... 335/16

FOREIGN PATENT DOCUMENTS 1169014 4/1964 Fed. Rep. of Germany .
2039881 1/1971 France .
2275866 1/1976 France .
45-1692 1/1970 Japan .
47-34053 12/1972 Japan .
47-44165 12/1972 Japan .
50-31886 9/1975 Japan .
52-65276 5/1977 Japan .
53-50847 12/1978 Japan .
WO83/02680 1/1983 PCT Int'l Appl. .
2078008 12/1981 United Kingdom .

*Primary Examiner*—Harold Broome
*Attorney, Agent, or Firm*—Young & Thompson

[57] ABSTRACT

The switch comprises a stationary contact (2) and a moving contact (3) subjected to the action of a magnetic component (12). The moving contact (3) is carried by a rocker-arm (4) which pivots about a pin (10) rigidly fixed to a control device (6). The extremity (4*a*) of the rocker-arm carries a second pivot-pin (15) which is connected to a mechanical threshold device (18). The second pivot-pin is capable of displacement between a normal position in which the contacts (2, 3) can be closed and opened by the control device and a trip position in which the contacts are permanently separated. The magnetic component (12) occupies a position such as to exert on the rocker-arm (4) a torque which increases the contact pressure prior to tripping of the threshold device and produces a pivotal displacement of the rocker-arm about its pivot-pin (10) in the direction of opening of the contacts after tripping of the threshold device (18).

11 Claims, 17 Drawing Figures

CONTROLLED OPENING AND CLOSING SWITCH WITH AUTOMATIC OPENING IN THE EVENT OF CURRENT OVERLOAD

BACKGROUND OF THE INVENTION

1. Field of the Invention

This invention relates to a switch designed to open and close under the control of a device such as an electromagnet and to open automatically in the event of overload current flow through the switch.

2. Description of the Prior Art

Switches such as contactors are already known in which the moving contact is directly connected to the armature of an electromagnet which controls the displacement of the moving contact against the action of restoring means, between a closed position and an open position of the contacts.

In some of these known contactors, means are also provided for initiating automatic opening of the contacts independently of the action of the electromagnet when the intensity of the current flow through the contactor oversteps a predetermined threshold value. These means can consist of a magnetic component which concentrates the field within a current loop in order to increase the intensity of the repulsion forces exerted on the moving contact. Automatic opening of the contacts is thus ensured when the current intensity exceeds a predetermined value which is usually of the order of thirty to forty times the rated value.

This type of switch thus has two different modes of operation as follows:

- a contactor mode in which opening of the contacts is controlled solely by the electromagnet;
- a mode of operation in the event of occurrence of any fault condition in which opening of the contacts takes place automatically at the time of appearance of short-circuit currents, independently of the action of the electromagnet, even though the electromagnet is located in an active position in which the contacts should be closed.

A device of this type is described for example in French patent application No. 80 120 86 filed on May 30th, 1980 in the name of the present Applicant.

The device described in this patent application comprises a plurality of switches of the type consisting of a rigid contact bridge in cooperating relation with stationary contacts carried respectively by conductors which impart repulsion forces to the contact bridge. In addition, the central region of the bridge cooperates with a magnetic structure for subjecting the bridge to forces which compensate for the contact pressure below a predetermined threshold value. Above this value, the bridge is separated very rapidly from the stationary contacts.

This known device is so designed as to initiate the operation of the aforementioned magnetic structure only in order to produce an additional contact pressure force which is directly opposed to the electrodynamic repulsion forces.

This is subject to a disadvantage insofar as the speed of separation of the contacts (which is necessary when a short-circuit occurs) suffers from a balance of forces which is reduced by reason of the opposite directions in which the aforementioned additional force and the repulsion forces are exerted whereas it would be desirable to utilize all the forces which are present for the purpose of accelerating the speed of opening of the contact bridge and thus limiting the intensity of the short-circuit currents even more effectively.

SUMMARY OF THE INVENTION

The object of the present invention is to overcome the disadvantages of known designs by producing a controlled opening and closing switch with automatic opening so designed as to have a high breaking capacity (a presumed effective value of the order of 100 KA) and to guarantee non-welding of contacts. The magnetic structure of said switch takes part in the generation of forces applied in the direction of opening of the moving contact as soon as the increase in contact pressure is no longer necessary.

The switch contemplated by the invention is capable of opening and closing under the action of a control device such as an electromagnet and of opening automatically in the event of overload current flow through the switch. Provision is made for a stationary contact and for a moving contact subjected to the action of a magnetic component which serves to enhance the pressure applied by the moving contact on the stationary contact below a predetermined threshold value. Said switch further comprises a mechanical threshold device which trips and initiates opening of the contacts when the magnetic component exerts on the moving contact a force which exceeds the force corresponding to the aforementioned current threshold value.

In accordance with the invention, the distinctive feature of the switch lies in the fact that the moving contact is carried by a rocker-arm pivotally mounted on a first pin which is rigidly fixed to the control device. The opposite end of said rocker-arm with respect to the end which carries the moving contact is provided with a second pivot-pin which is connected to the mechanical threshold device. Said second pivot-pin is capable of moving between a normal position which is maintained by the threshold device and in which the moving contact is applied against the stationary contact under the action of a spring, and a tripped position with respect to the threshold device in which the contacts are separated. In accordance with another distinctive feature, the magnetic component occupies with respect to the rocker-arm a position such as to exert on said rocker-arm a torque which is a function of the current flowing through the contacts, thereby enhancing the contact pressure prior to tripping of the mechanical threshold device and producing a pivotal displacement of the rocker-arm about its first pivot-pin which is rigidly fixed to the control device, after tripping of the threshold device.

The switch in accordance with the invention operates as follows: as long as the intensity of the current which flows through the switch does not attain the desired cutoff threshold value, the second pivot-pin of the rocker-arm is maintained stationary by the threshold device. The magnetic component exerts on the rocker-arm an electromagnetic force which tends to enhance the contact pressure and thus prevent any danger of welding of contacts. When the current which flows through the switch oversteps the desired threshold value, the force exerted by the magnetic component on the rocker-arm exceeds the reaction force of the threshold device. In consequence, the second pivot-pin of the rocker-arm disengages from the threshold device. The rocker-arm thus rotates about its first pivot-pin and causes the contacts to open.

Fast opening of the contacts at a predetermined current threshold value is thus obtained with high accuracy and without any attendant danger of welding of contacts. The means employed for the achievement of this objective are of remarkably simple design.

In accordance with one advantageous embodiment of the invention, the pivot-pin of the rocker-arm which is rigidly fixed to the control device is mounted with a predetermined axial clearance with respect to the rocker-arm or with respect to said control device in order to permit pivotal displacement of said rocker-arm through a small angle toward the magnetic component by rotating about the bearing point of the contacts after tripping of the threshold device. By virtue of the aforementioned clearance, the rocker-arm has a predetermined degree of freedom with respect to its first pivot-pin. Thus the force exerted by the magnetic component on the rocker-arm has the effect of increasing the pressure of the contacts prior to tripping of the threshold device.

In a first preferred embodiment of the invention, the mechanical threshold device comprises a spring applied against the second pivot-pin of the rocker-arm. An obtuse angle is made by the spring with the longitudinal direction of the rocker-arm and is open toward the magnetic component when the contacts are closed. Said spring makes an obtuse angle which is open in a direction away from the magnetic component when the contacts are open.

In another preferred embodiment of the invention, the mechanical threshold device comprises two balls which are placed side by side and project laterally from a retaining cage attached to the rocker-arm. These two balls are normally engaged respectively in openings formed in two blades pivotally mounted on a stationary support and extending on each side of the rocker-arm. By means of their openings, said blades are applied against the balls under the action of a spring.

BRIEF DESCRIPTION OF THE DRAWINGS

Other features of the invention will be more apparent upon consideration of the following description and accompanying drawings, wherein.

DESCRIPTION OF THE PREFERRED EMBODIMENTS

Figure 1:
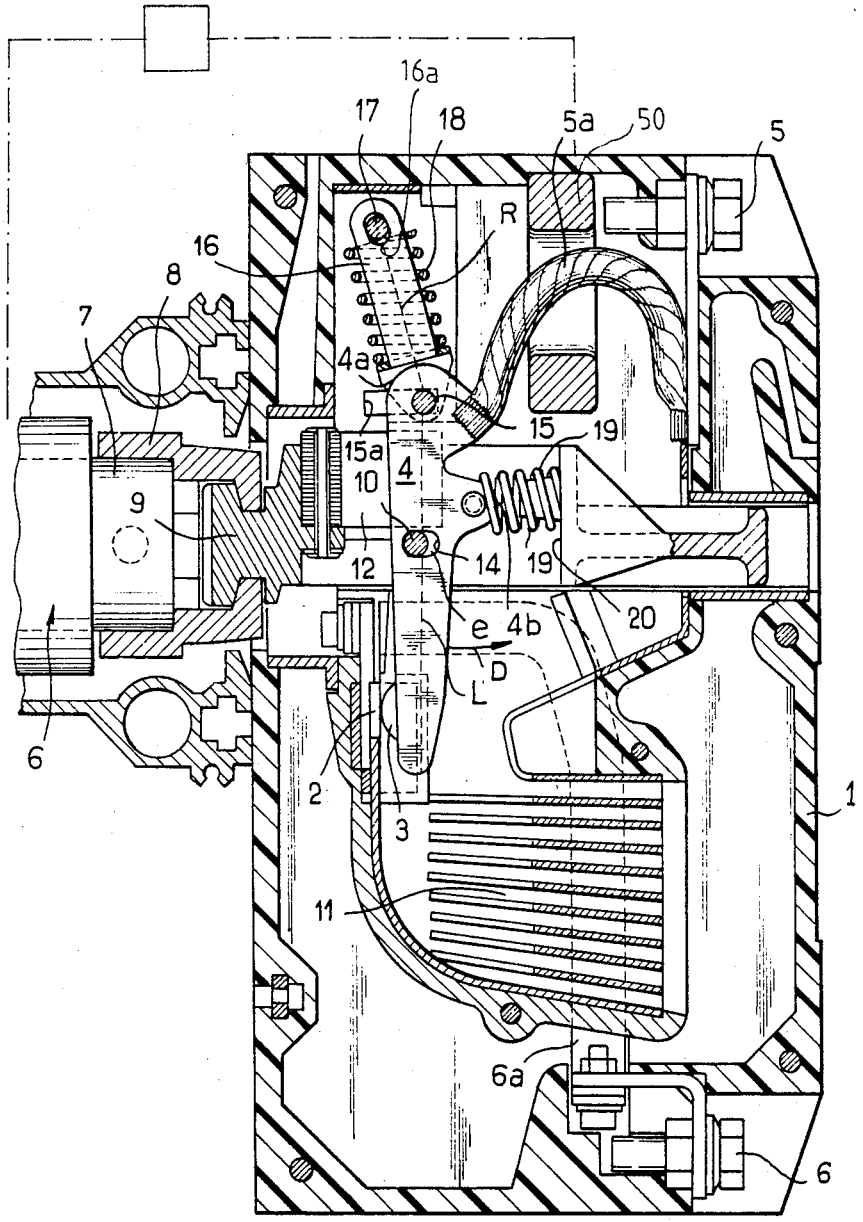
FIG. 1 is a longitudinal sectional view of a remote-controlled switch in accordance with the invention, the electromagnet being shown in the active position and the contacts being shown in the closed position.

In the embodiment of FIGS. 1 to 4, the switch in accordance with the invention comprises an outer casing 1 of electrically insulating material containing three juxtaposed switches each comprising a stationary contact 2 and a moving contact 3 carried by a rocker-arm 4. Said rocker-arm 4 and the stationary contact 2 are connected respectively to terminals 5 and 6 by means of conductors 5*a*, 6*a*.

An arc-quenching chamber 11 of conventional design is placed within the casing 1 opposite to the contacts 2 and 3.

There is placed opposite to the casing 1 an electromagnet 6, the moving armature 7 of which is attached to the rocker-arm 4 by means of a coupling member 8 and a movable contact-holder 9 which are both rigidly fixed to said moving armature. Said contact-holder 9 is adapted to carry a pivot-pin 10 on which is mounted the contact rocker-arm 4.

Figure 2:
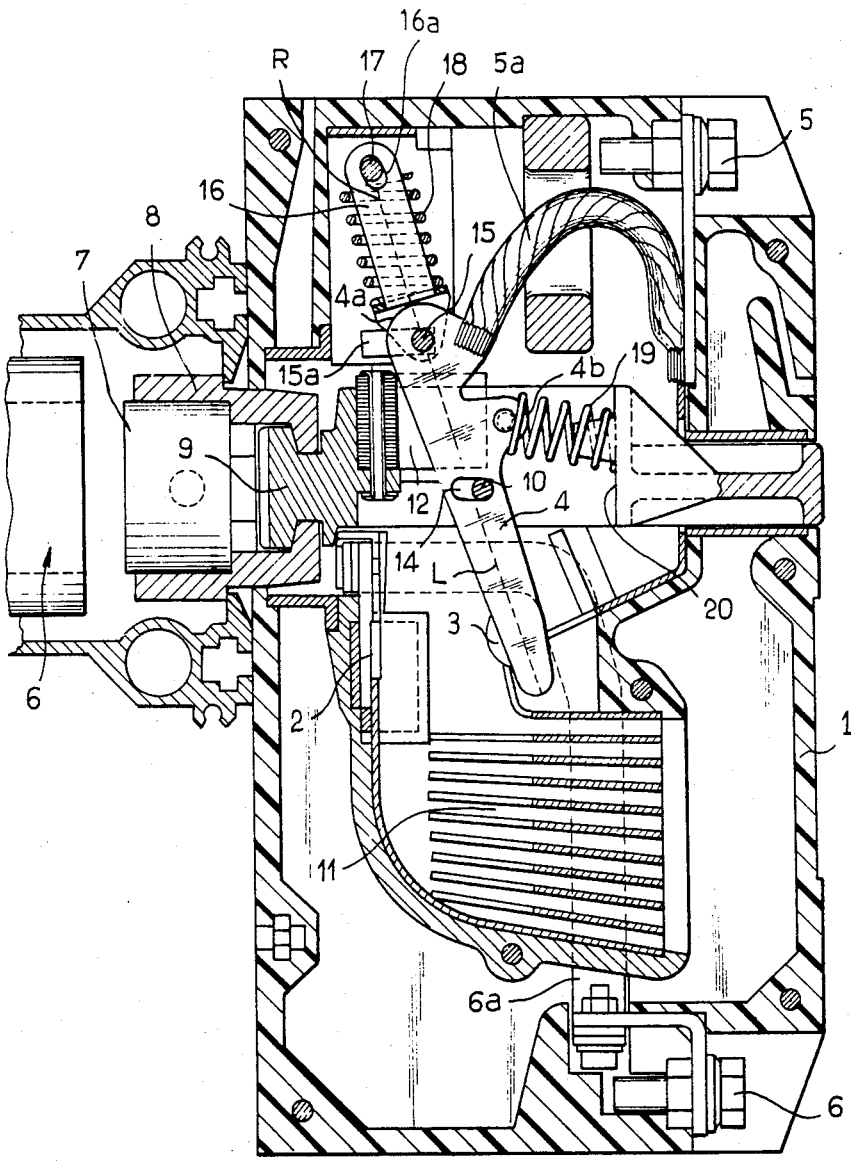
FIG. 2 is a view which is similar to FIG. 1, the electromagnet being in the inactive position and the contacts being in the open position.

During operation as a contactor, the electromagnet 6 controls the displacement of the contact rocker-arm 4 between a closed position of the contacts 2, 3 as shown in FIG. 1 and an open position of said contacts (as shown in FIG. 2).

The invention also provides means whereby opening of the contacts 2, 3 is initiated independently of the action of the electromagnet 6 when the intensity of the current flow through the contacts oversteps a predetermined threshold value which is equal for example to thirty or forty times the rated current intensity, and means for increasing the contact pressure below this threshold value.

Figure 5:
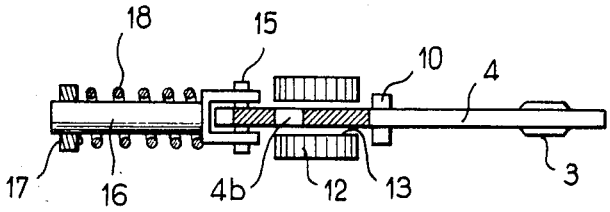
FIG. 5 is a part-sectional view taken along the plane V—V of FIG. 3.
Figure 6:
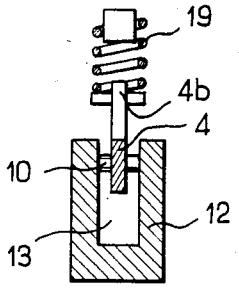
FIG. 6 is a part-sectional view taken along the plane VI—VI of FIG. 3.

To this end, the contact-holder 9 is provided on that face which is directed towards the contact rocker-arm 4, between the pivot-pin 10 and the rocker-arm extremity 4*a* which is remote from the contact 3, with a magnetic component 12 having a U-shaped cross-section (as also shown in FIGS. 5 and 6).

The contact rocker-arm 4 is engaged within the housing 13 defined by the U-section of the magnetic component 12.

It is further apparent from FIGS. 1 to 4 that the contact rocker-arm 4 has an elongated slot 14 which determines a radial clearance e with the pivot-pin which passes through said slot. When the contacts 2, 3 are closed (as shown in FIG. 1), said clearance e extends in the direction D of opening of the contacts with respect to the pivot-pin 10.

Moreover, the extremity 4*a* of the contact rocker-arm 4 which is remote from the contacts 2, 3 is adapted to carry a pivot-pin 15 on which is pivotally mounted a connecting-rod 16. Said connecting-rod is in turn pivotally coupled to a stationary pivot-pin 17 by means of an oblong opening 16*a* at its end remote from the rocker-arm 4, thereby providing a clearance in a direction R. On said connecting-rod 16 is mounted a spring 18 which applies a resilient force against the extremity 4*a* of the rocker-arm 4. The pivot-pin 15 of the connecting-rod 16 is housed within a groove 15*a* which guides said pin during its displacement between a normal position as shown in FIG. 1 and a tripped position shown in FIG. 4.

In the closed position of the contacts 2, 3 (shown in FIG. 1), an angle which opens in a direction opposite to the direction D of opening of the contacts and therefore toward the magnetic component 12 is made by the direction R (which passes through the axes of the pivot-pins 17, 15) of said spring 18 with the direction L which passes through the axis of the pin 15 and the center of the elongated slot 14 of the rocker-arm 4. In this position, the action of the spring 18 maintains the contacts 2, 3 applied against each other with a certain pressure.

Figure 4:
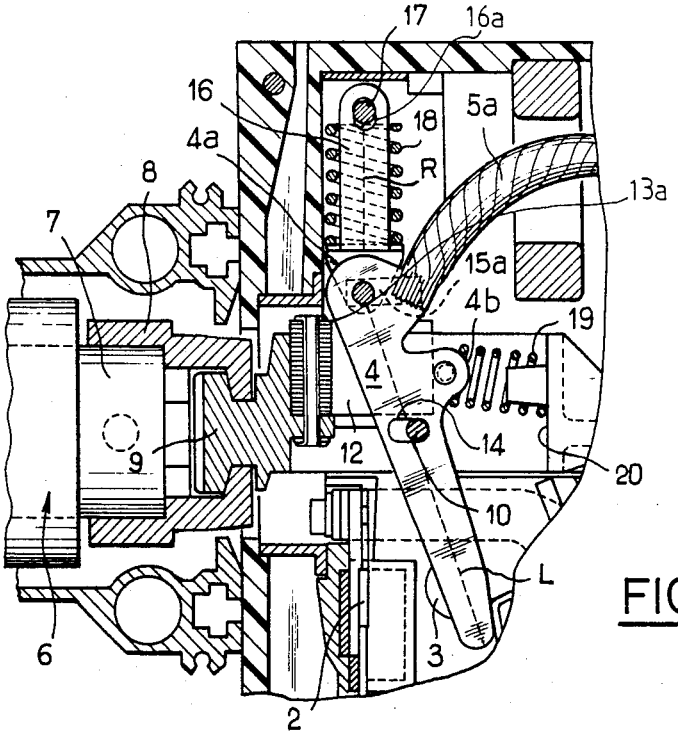
FIG. 4 is a view which is similar to FIG. 3, the moving contact being in the fully open position.

In the automatic open position of the contacts 2, 3 (as shown in FIG. 4), the direction R of the spring 18 makes an obtuse angle with the direction L of the rocker-arm 4. This angle opens in the direction D of opening of the contacts 2, 3 and is smaller when the electromagnet 6 is in the inactive position than when this latter is still in the active position (as shown in FIG. 2).

In these two positions (shown in FIGS. 2 and 4), the action of the spring 18 maintains the contacts 2, 3 in the open position.

Moreover, in a zone 4*b* remote from the electromagnet 6 and located substantially opposite to the magnetic component 12, that is to say between the pivot-pins 10 and 15, the rocker-arm 4 is urged by a second spring 19 against a stop 20 forming part of the contact-holder 9 and located opposite to the electromagnet 6. Said spring 19 exerts on the rocker-arm 4 a force which is substantially perpendicular to the longitudinal direction L of the rocker-arm 4 in order to apply the moving contact against the stationary contact with a suitable pressure when the electromagnet is active.

In the embodiment described in the foregoing, the spring 18, the articulation 17, 16*a*, the groove 15*a* and the pivot-pin 15 constitute a mechanical threshold device which trips and causes opening of the contacts 2, 3 when, under the action of the magnetic field produced at the time of flow of a current of predetermined value through the switch, the force exerted by the magnetic component 12 on the rocker-arm 4 exceeds the forces which maintain said rocker-arm in the closed position as will hereinafter be explained in greater detail.

The operation of the contactor which has just been described with reference to FIGS. 1 to 6 is as follows:

Supposing that the electromagnet is in the active position as long as the current intensity has a normal value, the contacts 2, 3 are applied against each other under the action of the resultant of the forces exerted by the springs 18 and 19.

When a fault condition occurs and the current intensity increases but does not attain the threshold value required in order to obtain automatic opening of the contacts, an electromagnetic attraction force is developed between the U-shaped magnetic component 12 and the contact rocker-arm 4. This attractive force remains smaller than the resultant of the forces exerted by the springs 18 and 19 on the rocker-arm 4 but would nevertheless be exerted in a direction in which it should reduce the pressure of the contacts if a clearance e did not exist, which would be liable to increase the contact resistance and consequently to cause welding of said contacts.

However, these risks are avoided by forming the clearance space e between the elongated slot 14 and the pivot-pin 10 of the rocker-arm 4. In fact, as long as the sum of magnetic attraction forces exerted on the rocker-arm 4 and of contact pressure exerted on the spring 19 is insufficient to overcome the force exerted by the spring 18, the pivot-pin 15 of the rocker-arm 4 which is adjacent to said spring remains motionless but the clearance space e endows the rocker-arm 4 with a degree of freedom such that the magnetic attraction force has the effect of enhancing the bearing pressure of the contacts 2 and 3.

When the current intensity attains the predetermined threshold value, the magnetic attraction force exerted between the rocker-arm 4 and the magnetic component 12 is sufficient to trip the threshold device constituted by the spring 18. The rocker-arm 4 then begins to rotate in a movement of pivotal displacement about the point of contact between the contacts 2 and 3 and through a small angle until the clearance e defined by the elongated slot 14 is reduced to zero.

Figure 3:
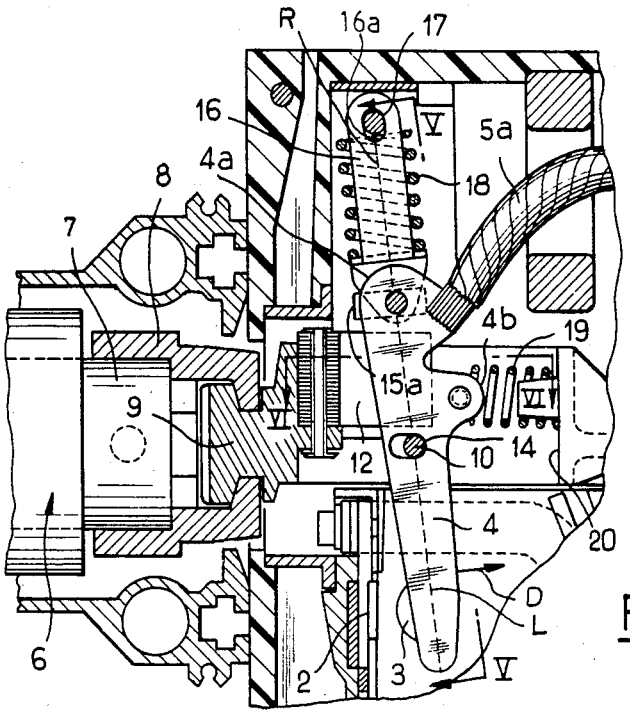
FIG. 3 is a fragmentary longitudinal sectional view of the switch in which the moving contact is at the start of the automatic opening stage when the electromagnet is in the active position.

The rocker-arm 4 then rotates about its pivot-pin 10 and the contact 3 moves away from the stationary contact 2 as indicated in FIG. 3. Up to the position of equilibrium shown in this figure in which the direction R of the spring 18 is aligned with the direction L of the rocker-arm 4, the spring 18 exerts a restoring force which progressively decreases, thereby forestalling any danger of accidental reclosing of the contacts 2 and 3.

Beyond the position of equilibrium (which is visible in FIG. 3), the obtuse angle made by the directions L and R is reversed and the action of the springs 18 and 19 produces a rapid pivotal displacement of the rocker-arm 4 toward the fully open position of FIG. 4. At the time of this displacement, the spring 19 exerts on the rocker-arm 4 an action which also tends to assist the opening movement of the rocker-arm 4. Thus, starting from the position of equilibrium shown in FIG. 3, opening of the contacts 2, 3 is considerably accelerated up to the position illustrated in FIG. 4.

In the respective arrangement of parts shown in FIG. 4, it is observed that the extremity 4*a* of the rocker-arm 4 has reached a position in which it bears against a point 13*a* located at the bottom of the housing 13 of the U-shaped component 12 and that the clearance e which is present between the elongated slot 14 and the pivot-pin 10 is located to the left of this latter.

The opening of the contacts 2, 3 is then ensured by displacement of the armature 7 of the electromagnet 6 to the inactive position. However, said electromagnet will not be de-energized. To this end, recourse will be had to known means (magnetic coil, static current detector) which observe the current intensity and come into action at a slightly lower speed. By way of example, these means are shown in FIG. 1 and are designated by the reference 50.

At the time of this displacement, the current-holder 9 is moved by restoring springs of the armature 7 toward the right-hand side of the figure, with the result that the pivot-pin 10 and the bearing point 13*a* of the component 12 first impart to the rocker-arm 4 a movement of translation toward the right, thus displacing the pivot-pin 15 toward the right end of the groove 15*a*. When passing beyond a neutral position in which the directions R and L are aligned, the action of the spring 18 on the pivot-pin 15 subjects the rocker-arm 4 to a slight clockwise movement of rotation about the pivot-pin 10. On completion of this movement, said pivot-pin 15 reaches a position in which it is abuttingly applied against the right end of the groove 15*a*. In consequence, the different parts are again located in the respective positions illustrated in FIG. 2.

During this displacement, the obtuse angle has increased in value and the threshold device 16, 17, 18 has been reset since the pivot-pin 15 has been restored to the normal position of operation. The stability of this state in which contacts are open is achieved by virtue of the respective angles of slope of the springs 18, 19, by virtue of the respective forces which they impart to the rocker-arm 4 and by virtue of the angle of slope of the direction R with respect to the groove 15*a*.

It is worthy of note that the opening time of the contacts 2, 3 is extremely short and is distinctly shorter than the time of response of the electromagnet 6.

It is thus apparent from the foregoing explanation of the operation of the switch in accordance with the invention that the pivot-pin 15 connected to the threshold device constituted by the spring 18 is capable of displacement between a normal rest position which is maintained against the right end of the groove 15*a* by the action of the spring 18 (as shown in FIG. 1) and a trip position in which the pivot-pin 15 is maintained at the left end of said groove (as shown in FIG. 4).

Displacement of said pivot-pin 15 between these two positions is controlled by the magnetic component 12 which exerts a torque on the rocker-arm 4. The value of torque is dependent on the intensity of current which flows through the contacts 2, 3. Said torque enhances the contact pressure prior to tripping of the threshold device (spring 18), that is to say as long as said torque has not attained the requisite value for tripping said threshold device.

By virtue of the arrangements described in the foregoing, the switch in accordance with the invention has a breaking capacity which can attain 100 kA (effective) with an absolute guarantee of non-welding of contacts at current intensities approximately within the range of 160 to 800 amps.

Figure 7:
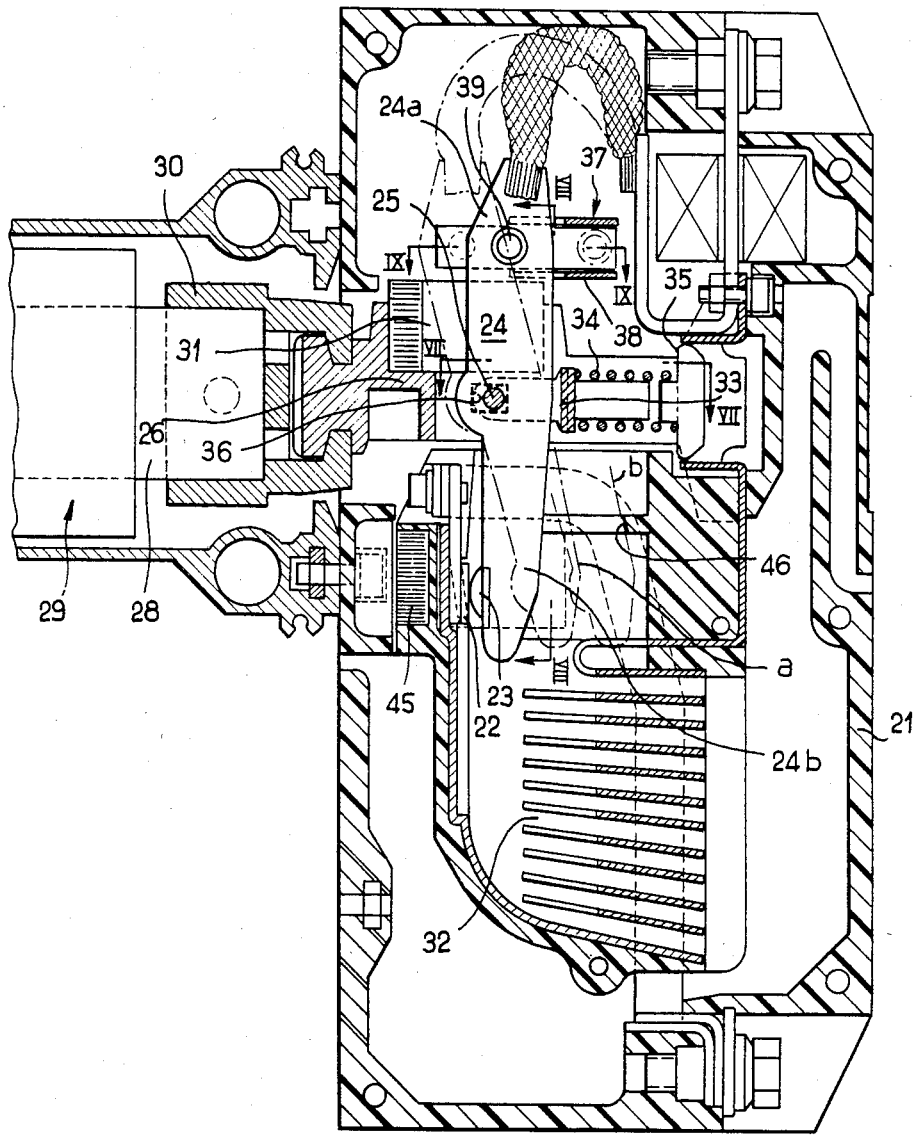
FIG. 7 is a longitudinal sectional view of a second embodiment of a switch in accordance with the invention.

In the embodiment of FIG. 7, the controlled-opening switch comprises as in the case of the preceding embodiment, an insulating casing 21 which contains a stationary contact 22 and a moving contact 23 carried by a rocker-arm 24 pivotally mounted on a pin 25. This pivot-pin 25 is attached to the end of a contact-holder 26 which is rigidly fixed to the armature 28 of the electromagnet 29 by means of a coupling member 30.

Figure 8:
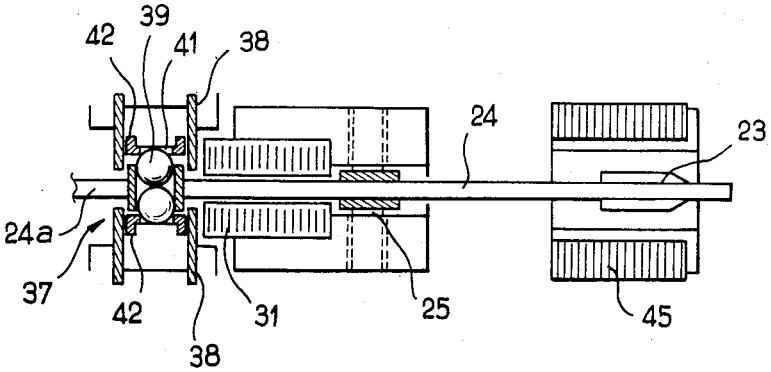
FIG. 8 is a part-sectional view taken along the plane VIII—VIII of FIG. 7.

The contact-holder 26 is also adapted to carry a U-shaped magnetic component 31. That portion of the rocker-arm 24 which is located behind the pivot-pin 25 with respect to the moving contact 23 (as also shown in FIG. 8) is engaged within the housing formed in said magnetic component 31.

As in the previous embodiment, an arc-quenching chamber is located opposite to the contacts 22, 23.

A link 33 pivotally mounted on the pivot-pin 25 of the contact rocker-arm 24 extends in the axis of displacement of the contact-holder 26. A spring 34 is applied at one end against said link 33 and at the other end against a stationary stop 35 which forms part of the contact-holder 26 (as also shown in FIG. 13).

Figure 13:
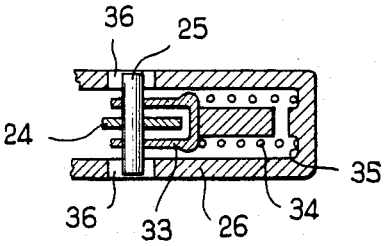
FIG. 13 is a sectional view taken along the plane VII—VII of FIG. 7.

In FIG. 13, it is apparent that the pivot-pin 25 of the rocker-arm 24 is mounted with play within elongated slots 36 formed in the contact-holder 26, thus permitting a slight relative axial displacement between the pivot-pin 25 and said contact-holder 26.

Figure 9:
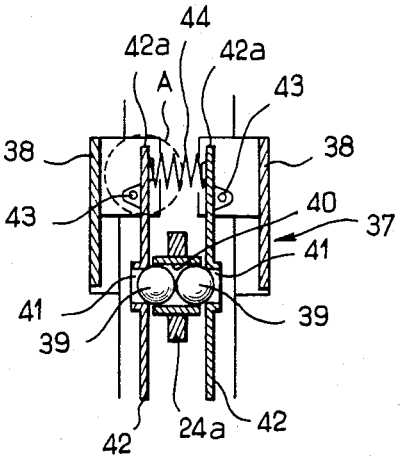
FIG. 9 is a part-sectional view taken along the plane IX—IX of FIG. 7.
Figure 10:
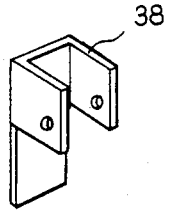
FIG. 10 is a perspective view showing one of the parts of the device illustrated in FIG. 9.
Figure 11:
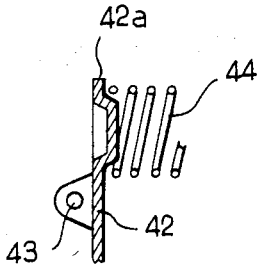
FIG. 11 is a view to a larger scale showing the detail A of FIG. 9.

The extremity 24*a* of the rocker-arm 24 which is remote from the contact 23 is adapted to carry a mechanical threshold device 37. As shown in FIG. 9, this device comprises two balls 39 which project outwards on each side of a cage 40 carried by the extremity 24*a* of the rocker-arm 24.

In the position illustrated in FIGS. 7, 8 and 9, the switch is in the closed position of the contacts. In this position, the two balls 39 are snap-actingly engaged in openings 41 formed in two blades 42 which extend transversely to the longitudinal axis of the rocker-arm 24 on each side of this latter.

These two blades 42 are pivotally attached to two stationary supports 38. The two pins 43 on which the blades 42 are pivoted to the stationary supports 38 extend substantially parallel to the direction of the rocker-arm 24 in the position shown in FIG. 7. Between those extremities 42*a* of the blades 42 which are remote from the openings 41 of these latter, there extends a spring 44 whose action is such that the openings 41 of the blades 42 are resiliently applied against the balls 39. The balls can thus be considered as being engaged within the openings 41 by resilient snap-action. Furthermore, this snap-action engagement system constitutes at the same time an axis of articulation which permits pivotal displacement of the rocker-arm 24 with respect to the stationary supports 38.

It is further apparent from FIG. 7 that the portion of the contact rocker-arm 24 which is adjacent to the moving contact 23 is engaged within another U-shaped magnetic component 45 which is stationary with respect to the casing 21. The action of said component with respect to the rocker-arm 24 is complementary to that of the magnetic component 31. This second magnetic component 45 is influenced at the time of current flow in such a manner as to exert a torque on the rocker-arm 24 in the same direction as the torque applied by the first magnetic component 31.

Moreover, a fixed stop 46 which is remote from the electromagnet 29 and the function of which will be explained hereinafter is placed opposite to the portion 24*b* of the rocker-arm 24 which extends between its pivot-pin 25 and the rocker-arm extremity which is adjacent to the stationary contact 22.

Figure 14:
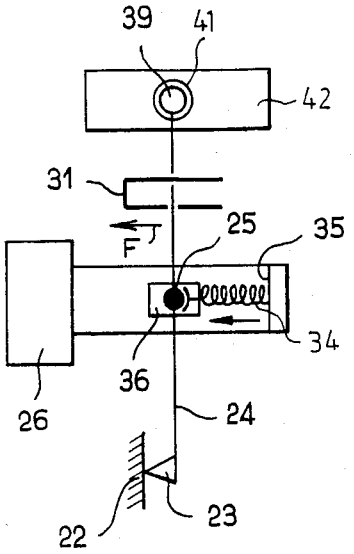
FIGS. 14 to 17 are diagrams which illustrate the operation of the switch in accordance with FIG. 7.

The operation of the switch illustrated in FIG. 7 is as follows:

When the current intensity exceeds the rated value but none the less remains below the desired cutoff threshold value, the attractive force F exerted by the U-shaped magnetic component 31 on the rocker-arm 24 tends to increase the pressure between the contacts 23 and 22 (as shown in FIG. 14). This result is obtained by virtue of the elongated slot 36 formed in the contact-holder 26 around the pivot-pin 25 of the rocker-arm 24. This accordingly avoids any danger of welding of contacts at medium current intensities.

When the current intensity attains the desired cutoff threshold value, the magnetic attraction force exerted between the rocker-arm 24 and the magnetic components 31 and 45 has the effect of balancing the force of reaction of the threshold device 37, that is to say the force which causes snap-action engagement of the balls 39 within the openings 41 formed in the blades 42.

Figure 12:
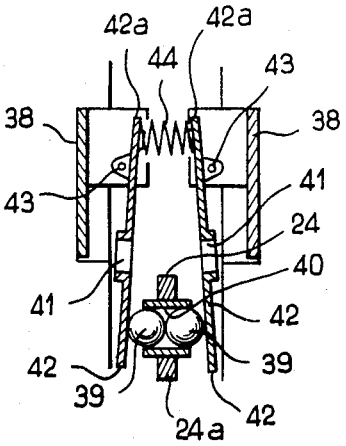
FIG. 12 is a view which is similar to FIG. 9 and shows the operation of the device.
Figure 15:
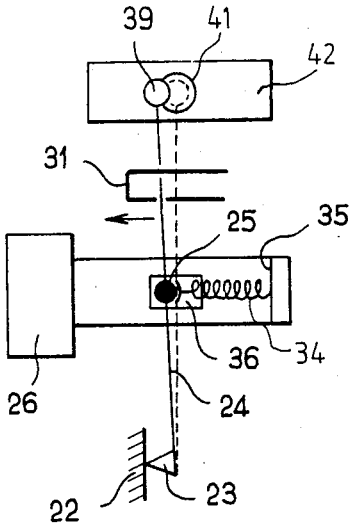
Figure 16:
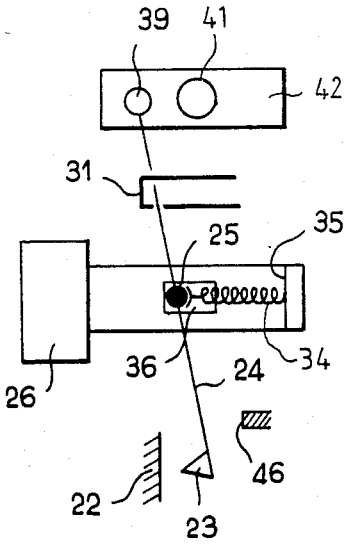

As soon as the current intensity exceeds the aforementioned threshold value, the balls 39 escape from the openings 41 by exerting an outward thrust on the blades 42 as shown in FIG. 12 and compressing the spring 44. The rocker-arm 24 first begins to pivot to a slight extent toward the magnetic component 31 by rotating about the point of contact of the contacts 22, 23 (as shown in FIG. 15) until suppression of the clearance defined by the elongated slot 36. The rocker-arm 24 then continues to pivot toward the magnetic component 31 by rotating about its pivot-pin 25 and takes up the position a indicated in chain-dotted lines in FIG. 7 or shown in the diagram of FIG. 16.

In this position, the balls 39 (see FIG. 12) remain in contact with the blades 42. As a result of the angle made between these blades 42 which is determined by the position of the pivot-pins 43 and the spring 44, the balls 34 are locked in position. The rocker-arm 24 is consequently maintained in the open position and any danger of accidental re-closure of the contacts 23 and 22 is avoided.

Figure 17:
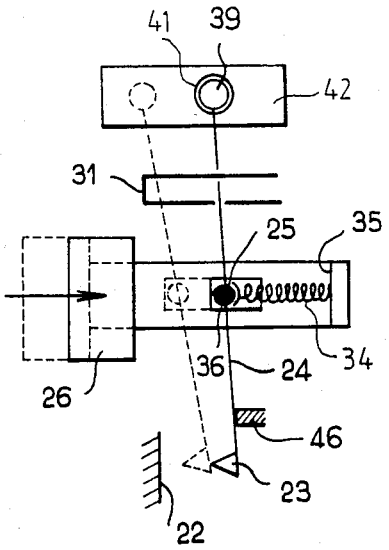

The armature 28 of the electromagnet 29 then displaces the rocker-arm 24 toward position b shown in chain-dotted lines in FIG. 7 (see also FIG. 17). When the rocker-arm 24 comes into contact with the fixed stop 46, said rocker-arm undergoes a forward movement of pivotal displacement about its pivot-pin 25. The balls 39 carried by the rear extremity 24*a* of the rocker-arm 24 move between the blades 42 toward the restoring spring 44 and accordingly re-engage within the openings 41 by snap action. The threshold device 37 is thus reset.

When the armature 28 of the electromagnet 29 is restored to its initial position, the contact rocker-arm 24 returns to the position shown in FIG. 7 in which its contact 23 is applied under pressure against the stationary contact 22.

From the foregoing explanation of the operation of the switch shown in FIG. 7, it is thus apparent that the axis of articulation defined by the balls 39 which form part of the threshold device 37 is capable of displacement between a normal position of rest which is maintained by virtue of the force of snap-action engagement of the balls 39 as obtained by the spring 44 in which the moving contact 23 is applied against the stationary contact 22 and a trip position in which the contacts are separated.

The displacement between these two positions is controlled by the combined action of the magnetic components 31 and 45 which exert a torque on the rocker-arm 24, said torque being a function of the intensity of current which passes through the contacts 22, 23. This torque increases the contact pressure prior to tripping of the threshold device 37, that is to say as long as said torque has not attained the requisite value for releasing the threshold device.

Compared with the switch illustrated in FIGS. 1 to 6, the switch shown in FIG. 7 offers a number of advantages including more reliable operation and less stringent requirements in regard to accuracy of assembly of its different components.

As in the case of the embodiment of FIGS. 1 to 6, the contactor shown in FIG. 7 has a breaking capacity which can attain 100 kVA with guaranteed non-welding of contacts at current intensities approximately within the range of 160 to 800 amps.

As will readily be understood, the invention is not limited to the examples of construction described in the foregoing and many modifications can accordingly be contemplated without thereby departing either from the scope or the spirit of the invention.

Thus the single contact rocker-arm 4 or 24 can be replaced by double arms or levers which are capable of moving toward each other. It is only necessary in this case to provide for each lever a U-shaped magnetic component and restoring and/or locking means which are identical with those of the embodiments shown in FIGS. 1 to 4 and 7.

In addition, these restoring and/or locking means can be different from those described, the main point being that they must exert on the rocker-arm or arms a force which maintains the contacts in the closed position as long as the attractive force exerted by the magnetic component 12 or 31 has not attained the desired value for initiating the opening of contacts. It is also essential to ensure that these means permit acceleration of opening of the contacts as soon as this opening movement starts in order to guard against any risk of contact re-closure on high-intensity currents. These means associated with a magnetic component permit a combination of oppositely-acting movements which are not evident and are obtained with a remarkable economy of means.

Furthermore, the control device 1 consisting of the electromagnet 6, 29 can be replaced by a mechanical setting device which initiates closure of the contacts by hand and which is capable of opening either manually in order to effect normal opening or by internal or external tripping means for confirming automatic opening.

What is claimed is:

1. A switch designed to open and close under the action of a control device such as an electromagnet (6, 7, 28, 29) and to open automatically in the event of overload current flow through the switch, said switch being provided with a stationary contact (2, 22) and a moving contact (3, 23) subjected to the action of a magnetic component (12, 31) which serves to increase the pressure applied by the moving contact on the stationary contact below a predetermined current threshold value as well as a mechanical threshold device (18, 37) which trips and initiates opening of said contacts when the magnetic component exerts on the moving-contact rocker-arm a force which exceeds the force corresponding to the aforementioned current threshold value, wherein the moving contact (3, 23) is carried by a rocker-arm (4, 24) pivotally mounted on a first pin (10, 25) which is rigidly fixed to the control device (6, 29), the opposite end (4*a*, 24*a*) of said rocker-arm with respect to the end which carries the moving contact being provided with a second pivot-pin (15, 39) which is connected to the mechanical threshold device (18, 37), said second pivot-pin being capable of moving between a normal position which is maintained by the threshold device and in which the moving contact (3, 23) is either capable or not capable of cooperating with the stationary contact according as the control device is active or inactive and a tripped position with respect to the threshold device in which the contacts are separated even when said control device is active, wherein the magnetic component (12, 31) occupies with respect to the rocker-arm (4, 24) a position such as to exert on said rocker-arm a torque which is a function of the current flowing through the contacts, thereby increasing the contact pressure prior to tripping of the threshold device and producing a pivotal displacement of the rocker-arm about its pivot-pin (10, 25) which is rigidly fixed to the control device in the direction of opening of the contacts after tripping of said threshold device.

2. A switch according to claim 1, wherein the magnetic component (12, 31) has a U-shaped section, wherein the pivoting portion located between its two pivot-pins (10, 15; 25, 39) is engaged within the housing (13) defined by the U-shaped section of the magnetic component and wherein said component is carried by a movable portion (9, 26) which is rigidly fixed to an armature (7) of the switch-control electromagnet.

3. A switch according to claim 2, wherein the pivot-pin (10, 25) of the rocker-arm which is rigidly fixed to the movable portion (9, 26) provides a predetermined radial clearance (e) with respect to the rocker-arm in order to permit pivotal displacement of said rocker-arm through a small angle towards the magnetic component (12, 31) by rotating about the bearing point of the contacts (2, 3; 22, 23) prior to tripping of the threshold device.

4. A switch according to claim 1, wherein the mechanical threshold device comprises in particular a spring (18) applied against said second pivot-pin (15) of the rocker-arm (4), an obtuse angle being made by said spring with the longitudinal direction (L) of the rocker-arm and being open towards the magnetic component (12) when the device is in the normal position, an obtuse angle being made by said spring (18) with the direction (L) and being open in a direction away from the magnetic component (12) when the device is in the tripped position.

5. A switch according to claim 1, wherein a contact-pressure spring (19) exerts on the rocker-arm (4) a force which is substantially perpendicular to the longitudinal direction L of said rocker-arm when the contacts (2, 3) are closed, said force being applied on the one hand against the rocker-arm (4) at a point (4*b*) located opposite to the magnetic component (12) and between the two pivot-pins (10, 15) of said rocker-arm (4) and being oriented on the other hand in the direction of the attractive force exerted by said magnetic component.

6. A switch according to claim 3, wherein the rocker-arm (4) has an elongated slot (14) in which the pivot-pin (10) of said rocker-arm is engaged, the axial clearance (e) aforesaid being determined by said elongated slot.

7. A switch according to claim 3, wherein the mechanical threshold device (37) comprises two balls (39) placed side by side and adapted to project laterally from a retaining cage (40) attached to the rocker-arm (24), said two balls being normally engaged respectively in openings (41) formed in two blades (42) pivotally mounted on a stationary support (38) and extending on each side of the rocker-arm (24), said blades being applied against the balls (39) by said openings (41) under the action of a spring (44).

8. A switch according to claim 7, wherein the pivot-pin (25) of the rocker-arm (24) is stationarily fixed with respect to this latter and engaged in elongated slots (36) formed in a contact-holder (26) which is rigidly fixed to a control device (29) and which also carries the magnetic component (31), the radial clearance aforesaid being defined by said slots (36) with the pivot-pin (25).

9. A switch according to claim 7, wherein a spring (34) exerts on the pivot-pin (25) of the rocker-arm (24) a force which is substantially perpendicular to the longitudinal direction of the rocker-arm when the contacts (22, 23) are closed and which is directed towards the magnetic component (31).

10. A switch according to claim 7, wherein a fixed stop (46) ls placed in a position remote from the control device and opposite to the portion (24*b*) of the rocker-arm (24) which extends between its pivot-pin (25) and the moving contact (23), the position of said fixed stop being so determined that when the rocker-arm (24) is disconnected with respect to the threshold device and displaced by the control device (29) to the open position, said rocker-arm is permitted to bear against said stop (46) and to undergo a movement of pivotal displacement in order to be reconnected to said threshold device.

11. A switch according to claim 1, wherein a second magnetic component (45) is placed opposite to that portion of the rocker-arm (24) which extends between the moving contact (3, 23) and its pivot-pin (10, 25), said second magnetic component being adapted to exert a torque on the rocker-arm in the same direction as the torque applied by the first magnetic component (12, 31).

* * * * *

UNITED STATES PATENT AND TRADEMARK OFFICE

CERTIFICATE OF CORRECTION

PATENT NO. : 4,571,565

DATED : February 18, 1986

INVENTOR(S) : Elie BELBEL et al.

It is certified that error appears in the above—identified patent and that said Letters Patent is hereby corrected as shown below:

ON THE COVER SHEET:

Item [75] Inventors: change "Andreé Haury" to --André Haury--.

Signed and Sealed this

*First* Day of *July 1986*

[SEAL]

*Attest:*

DONALD J. QUIGG

*Attesting Officer*

*Commissioner of Patents and Trademarks*